US007128636B1

(12) United States Patent
Marino et al.

(10) Patent No.: US 7,128,636 B1
(45) Date of Patent: Oct. 31, 2006

(54) SWING WIRE AND BRASSIERE USING SAME

(76) Inventors: Nicholas A. Marino, 108 Flamboyan, Vieques, PR (US); Gerhard Fildan, Wohnpark Alte Erlaa, Anton-Baumgartner Str.44, A-1232 Vienna (AT); Karl Wanzenböck, Traumansdorffstrasse 13, A-2544 Leobersdorf (AT)

( * ) Notice: Subject to any disclaimer, the term of this patent is extended or adjusted under 35 U.S.C. 154(b) by 0 days.

(21) Appl. No.: 11/232,424

(22) Filed: Sep. 21, 2005

(51) Int. Cl.
*A41C 3/14* (2006.01)
*A41C 3/12* (2006.01)

(52) U.S. Cl. ..... 450/41; 450/47; 450/45; 450/51; 450/52

(58) Field of Classification Search ..... 450/41, 450/45, 47, 48, 52, 53, 51; 2/255–259, 261, 2/262, 264
See application file for complete search history.

(56) References Cited

U.S. PATENT DOCUMENTS

| | | | | | |
|---|---|---|---|---|---|
| 2,438,062 | A * | 3/1948 | Licht | 450/30 |
| 2,453,485 | A * | 11/1948 | Axtell | 63/14.2 |
| 2,595,088 | A * | 4/1952 | Licht | 450/52 |
| 3,037,211 | A * | 6/1962 | Bohm | 2/256 |
| 3,114,374 | A * | 12/1963 | Chalfin et al. | 450/41 |
| 3,209,756 | A * | 10/1965 | Rowell | 450/52 |
| 5,967,877 | A * | 10/1999 | Howard | 450/57 |
| 6,186,862 | B1 * | 2/2001 | Fildan | 450/41 |
| 6,447,365 | B1 | 9/2002 | Powell | |

* cited by examiner

*Primary Examiner*—Gloria M. Hale
(74) *Attorney, Agent, or Firm*—Andrew Wilford

(57) ABSTRACT

An underwire for brassieres which is split in the width and the split extends substantially the full length of the underwire to the rounded ends. The split defines two segments, one of which can swing out of the plane of the other to thereby strengthen the underwire while providing a measure of flexibility.

18 Claims, 7 Drawing Sheets

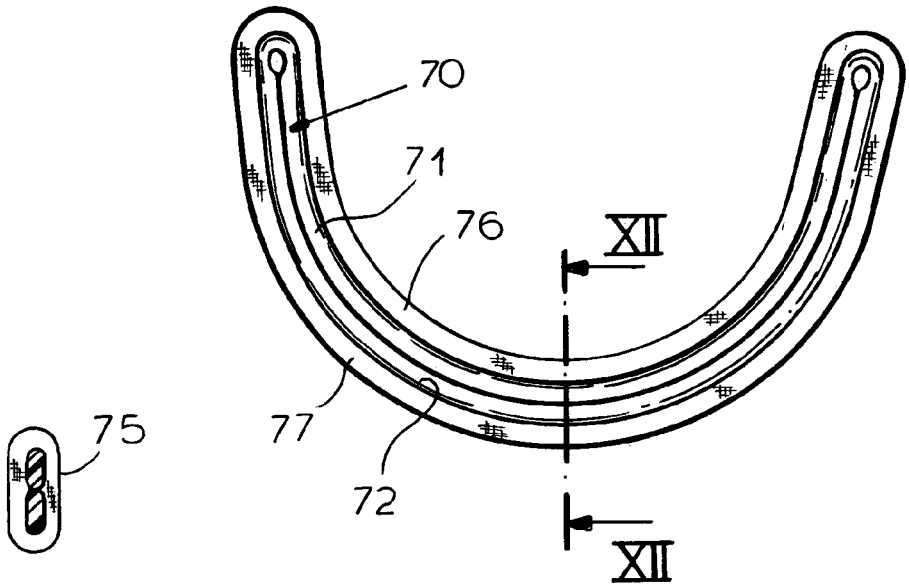
FIG.12
FIG.11
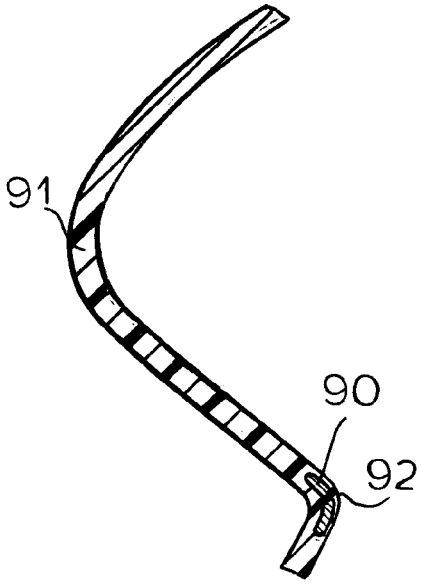
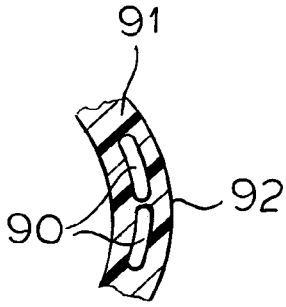
FIG.13
FIG.14

SWING WIRE AND BRASSIERE USING SAME

FIELD OF THE INVENTION

Our present invention relates to an underwire for a brassiere cup and to a brassiere having such underwires received in stitched pockets beneath and extending around the brassiere cup.

BACKGROUND OF THE INVENTION

Underwire brassiere are available in a wide variety of configurations with underwires which can be made of metal, of plastic or plastic-coated metal, which are round or flattened or of hybrid configuration, which may have rounded ends to facilitate insertion into a stitched channel along the bottom of a brassiere cup to lie against the sternum of the wearer, may have stitching flanges enabling them at various locations to be stitched into the garment and may have configurations which change along the length so as to have variable flexibility within the plane of the underwire or transverse to that plane.

The underwire imparts shape to the cup of the brassiere and has a stiffness or flexibility required to maintain a particular shape or allow various degrees of mobility. The underwire may, in addition, be received under a certain prestress in the channel beneath and around the cup so as to press inward against the breast for enhancement purposes.

Underwires of various shapes are also available in various sizes to accommodate different bust sizes and breast shapes and sizes.

OBJECTS OF THE INVENTION

The principal object of the present invention is to provide an improved brassiere underwire which will have advantageous features of prior wires but which will provide, where necessary, greater strength in combination with a certain degree of greater flexibility than could be achieved heretofore with the conventional underwire.

Another object of this invention is to provide an improved underwire brassiere which uses the advanced underwire and thereby provides a more comfortable fit, especially for women whose breasts may not be of exactly the same size.

Another object of this invention is to provide an underwire and underwire brassiere capable of self-adjustment to breasts of different sizes.

Finally it is an object of the invention to provide an underwire which when fitted into a brassiere, affords greater comfort than has hitherto been obtainable with brassiere underwires of similar dimensions.

SUMMARY OF THE INVENTION

These objects and others which will become apparent hereinafter are attained, in accordance with the present invention in a brassiere underwire having an arcuate body of generally U-shape, a flattened cross section, rounded free ends and a split extending from one of these ends to the other of these ends continuously so as to subdivide the body between the ends into two half wire segments, each of which extends in excess of 180° of a substantially circular arc forming the bight of the underwire.

Each of those segments is generally flattened and in a relaxed condition, the two segments lie in a plane of the wire. However, each of the segments can be deflected within limits relative to the other segment in a swinging action.

The swinging action enables the outer segments to lie to either side of the inner segments vice versa and provides an underwire which is twice the strength of a single plastic wire of the width of one of the segments, has a substantially wider wire area which is more comfortable when incorporated into a brassiere, affords a degree of flexibility transverse to the plane which may not be present in single-wire brassieres, provides greater conformity to a woman's breast and especially can accommodate breasts of different sizes for an individual without requiring custom made brassieres, precludes poke-through of the underwire (because of the rounded wide ends), provides a double lift effect for the bosom and ensures greater adaptability to the body and to body movement.

Furthermore the wire can bridge sizes so that only a single wire need be provided for a number of brassiere sizes, say the brassiere sizes 34A and 34B.

We have found, moreover, that it is of advantage to mold the swing wire into the cup of a foam synthetic resin and, in conjunction therewith, to impart an outwardly concave cross section to the swing wire when it is so molded in the cup. Advantageously, the inner limb of the swing wire can be provided so that it is generally softer or less stiff than the outer limb and the entire swing wire may be encased in a foam synthetic resin which is softer than the material from which the underwire is made. In another embodiment, a foam synthetic resin material can be bonded to the upper limb (i.e. the inner limb) of the swing wire and a tab of the foam synthetic resin can be provided at the end of the swing wire which is to be located at the center of the front of the brassieres.

BRIEF DESCRIPTION OF THE DRAWING

The above and other objects, features, and advantages will become more readily apparent from the following description, reference being made to the accompanying drawing in which:

FIG. 11 is a view similar to FIG. 10 of still another swing wire arrangement;

FIG. 12 is a cross sectional view of the swing wire of FIG. 11 taken along the line XII—XII of FIG. 11;

FIG. 13 is a cross sectional view through a bra cup with the swing wire molded in place; and FIG. 14 is a detailed view showing the concave cross section of the swing wire embedded in the cup material.

SPECIFIC DESCRIPTION

Figures 1, 2:
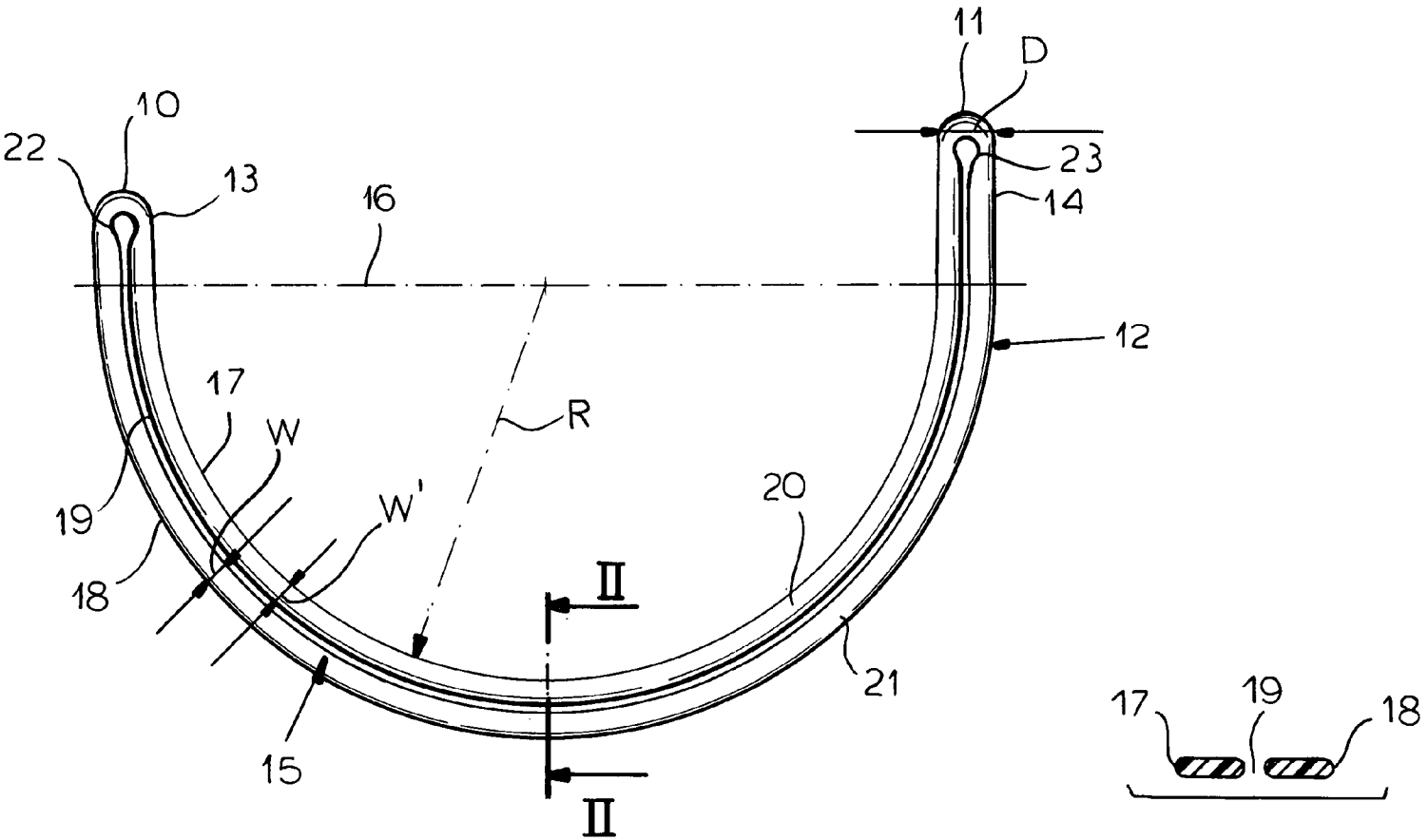
FIG. 1 is an elevational view of the underwire of the invention.
FIG. 2 is a cross sectional view taken of line II—II thereof.

The underwire shown in FIG. 1 by way of example has a pair of rounded ends 10 and 11 formed on a body 12 which is generally flat and planar and is composed of a synthetic resin material such as nylon. The rounded ends may be formed on extremities 13 and 14 which asymmetrically extend beyond the rounded portion or bight 15 of the underwire body. A dot-dash line 16 through approximately the center of curvature of this bight delimits the bight from the extensions 13 and 14 for the sake of illustration. Below this dot-dash line 16, the bight or arcuate portion of the underwire subtends approximately 180°. The radius of curvature has been represented at R and is not constant over the length of the bight and thus has been presented only for illustration purposes. The inner and outer edges 17 and 18 are also rounded as can be seen from the cross sectional view of FIG. 2 and the underwire is subdivided by a split 19 into an inner segment 20 and an outer segment 21. The split 19 extends continuously between its ends 22 and 23 close to the rounded ends of the underwire. Because of the split, one of the segments 20 can be swung out of the plane of the other (see FIG. 3).

The widths W and W' of the two segments can be equal and can be approximately half the width D of the body at ends thereof. The width D of the body can be uniform over its length except for the rounded portions at the end and the widths W and W' can be uniform over the lengths of the segments. In practice, each width W, W' may be the width of a normal underwire so that the doubled width of the present underwire can afford significantly greater strength in brassiere applications than could be obtainable with previous underwires although the underwire of the invention has significantly increased flexibility.

The thickness of the body may be 2.15 mm±0.25 mm. A typical width of the body may be about 8 mm±0.5 mm and the width of the segments may be about 4 mm±0.25 mm. The diameter at the line 16 of FIG. 1 for a common size of a brassiere may be 11.4 mm±0.5 mm, and the radius of curvature R may be about 5.2 mm±0.25 mm, by way of example.

Figure 3:
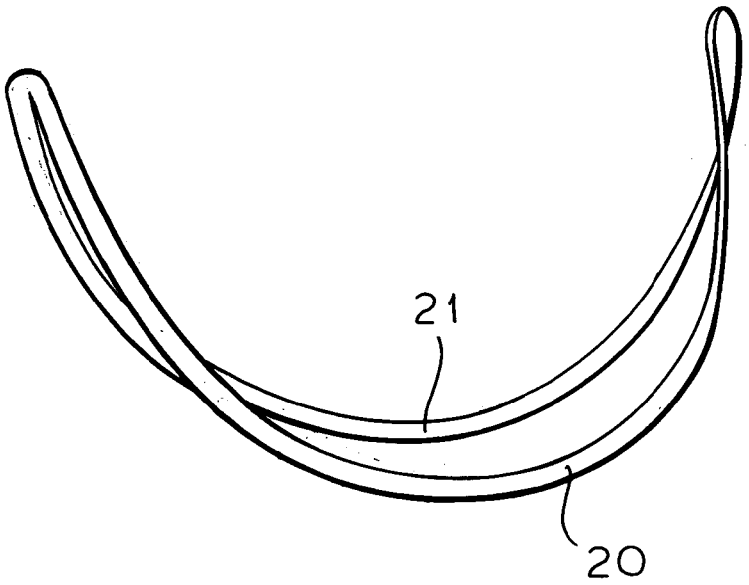
FIG. 3 is a somewhat diagrammatic perspective view showing one of the segments swung out of the plane of the wire.
Figure 4:
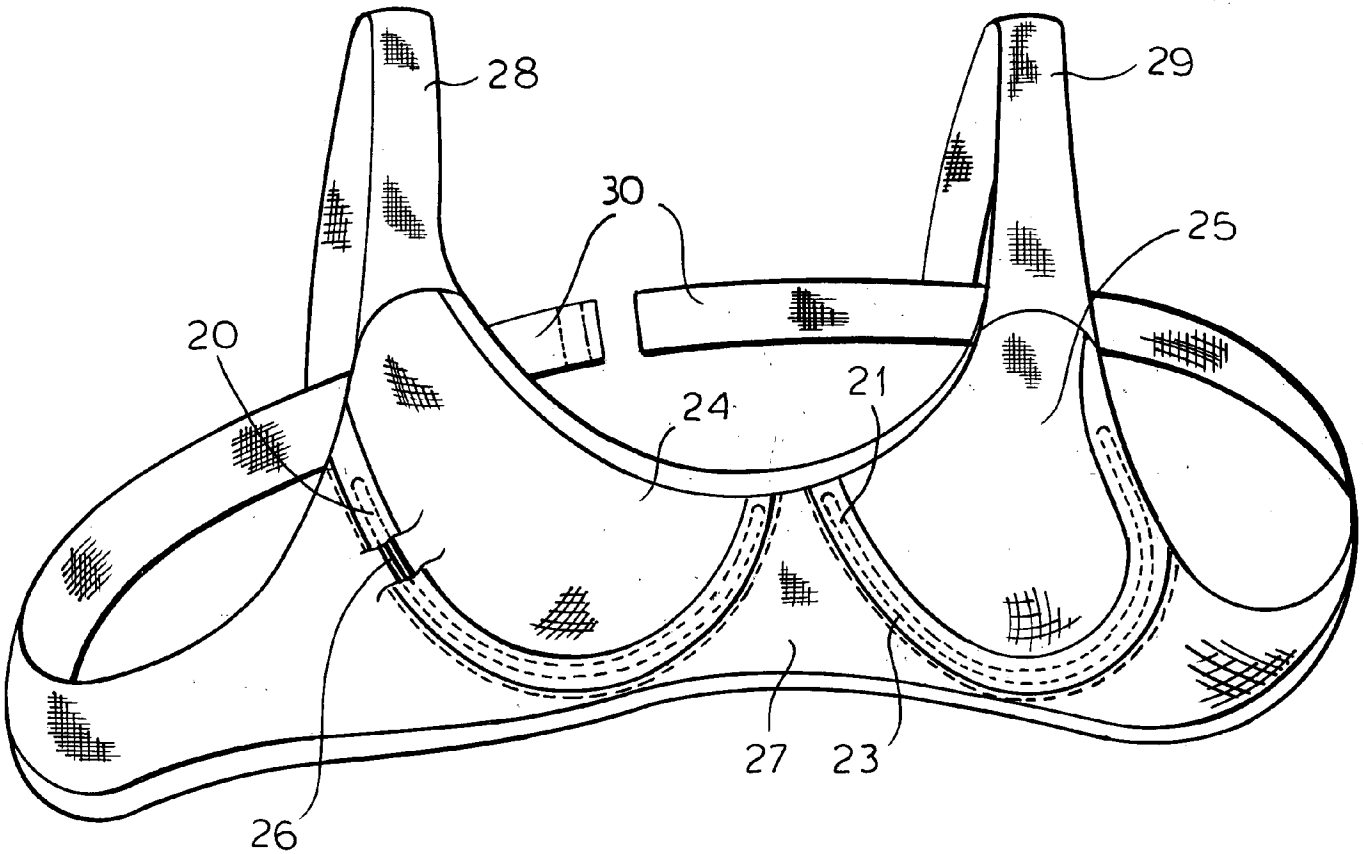
FIG. 4 is a diagrammatic illustration of a brassiere in a perspective view showing the underwire of the invention in place.

Referring now to FIG. 4, it can be seen that the underwire 20 or 21 of the type shown in FIGS. 1 to 3 can be incorporated into arcuate pockets 22 and 23 stitched below respective brassiere cups 24 and 25. At the left side in FIG. 4 one can see the split 26 in the underwire 20 of the cup 24. The brassiere is provided with a fabric front 27 to which the cups are stitched, shoulder straps 28 and 29 and a back strap 30, all shown diagrammatically. The adjustment buckles and loops and corresponding clasps have not been illustrated.

The underwire of the present invention has been found to be ideal for minimizer brassieres which have cups of large diameter but which are relatively shallow to reduce the overall appearance of the bosom. The fact that the wire can overbridge two sizes has been found to be helpful not only in the case in which the two breasts are of different sizes but also in the case in which a size change may occur. In all cases, during wearing and the swinging of the wire, i.e. the spreading of the segments, the wire becomes stiffer and that has proved to be an important advantage.

Figure 5:
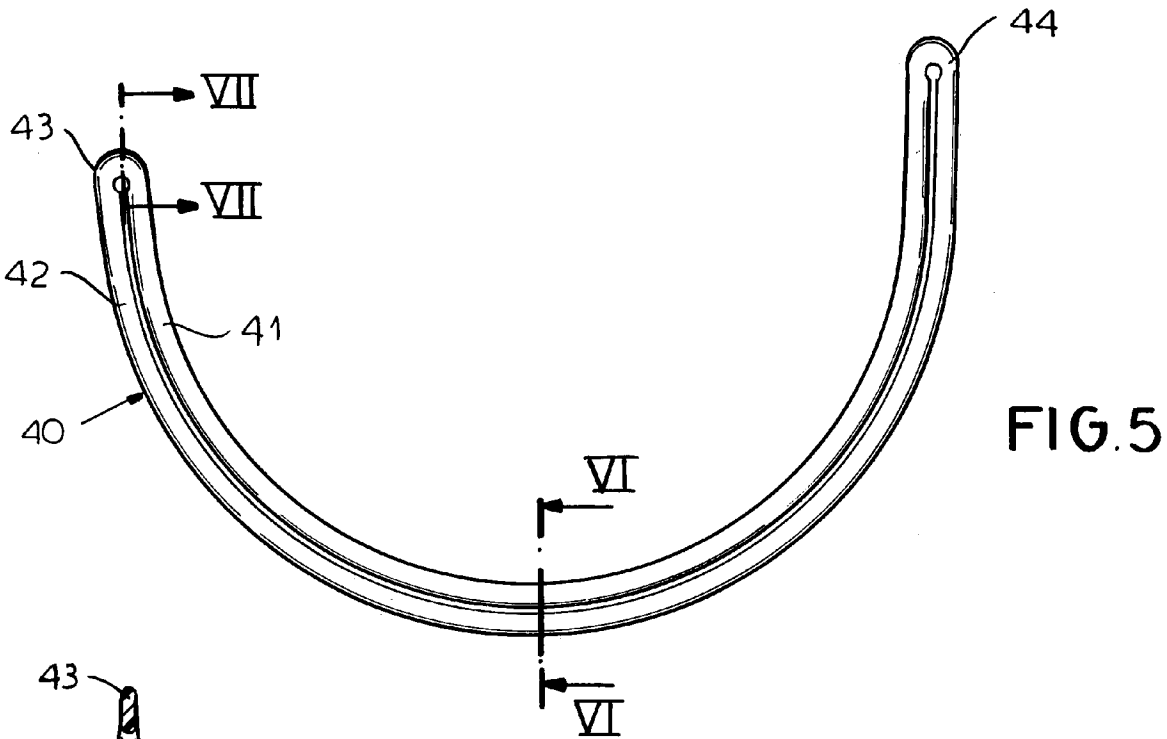
FIG. 5 is an elevational view of a modified swing wire according to the invention.
Figure 6:
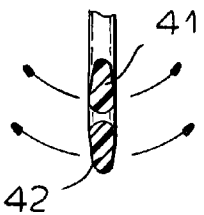
FIG. 6 is a cross sectional view taken along the line VI—VI of FIG. 5.
Figure 7:
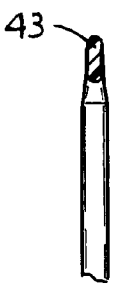
FIG. 7 is a cross sectional view taken along the line VII—VII of FIG. 5.

In FIG. 5, we have shown another swing underwire 40 with an inner limb 41 and an outer limb 42 formed integral with one another and joined at curved ends 43 and 44, respectively. As can be seen from FIG. 7, the ends 43, 44 may be flattened relative to the limbs 41 and 42 which, as shown in FIG. 6 can have tapering cross sections inwardly and outwardly, respectively. Advantageously, the outer limb 42 maybe somewhat more stiff or harder than the inner limb 41, either by varying the material forming the two limbs or by providing the outer limb 42 with a larger cross sectional area than the inner limb 41.

Figure 8:
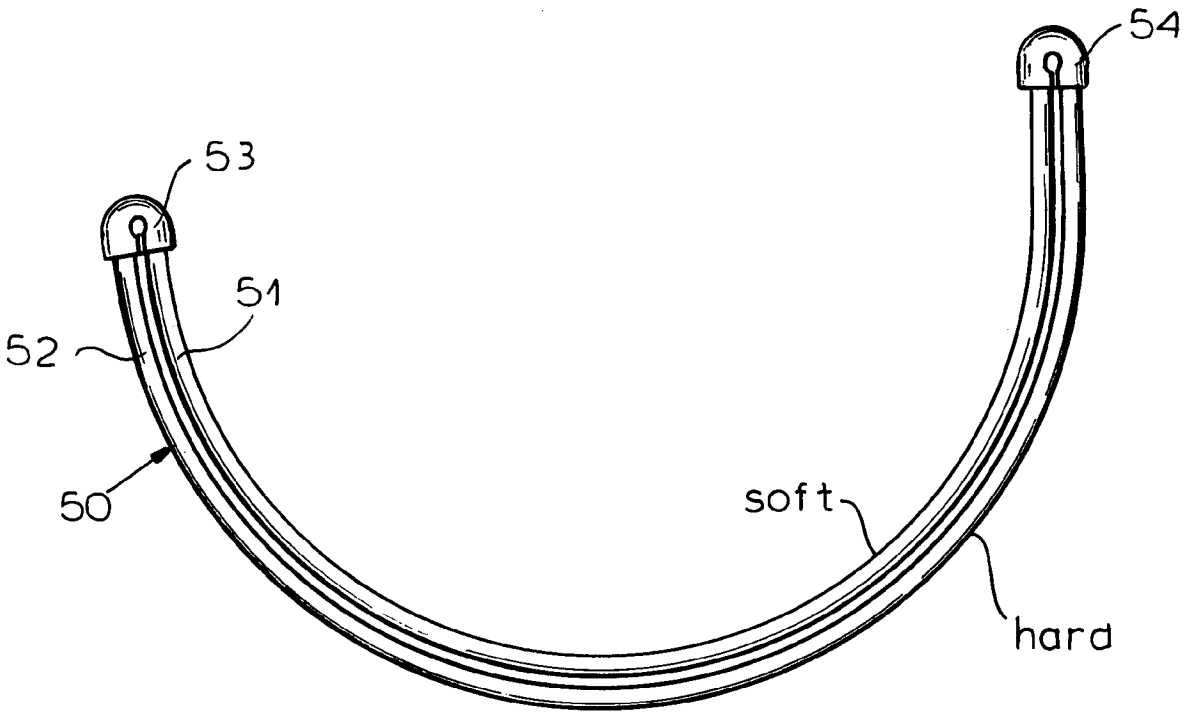
FIG. 8 is an elevational view of another swing wire.

In FIG. 8, we have shown an embodiment wherein the swing underwire 50 is formed with an inner limb 51 and an outer limb 52 of different materials entirely, joined together at their ends by U-shaped members 53 and 54 molded onto the inner and outer limbs, 51, 52. The inner limb 51 is generally softer and less rigid while the outer rim 52 can be harder or stiffer.

Figure 9:
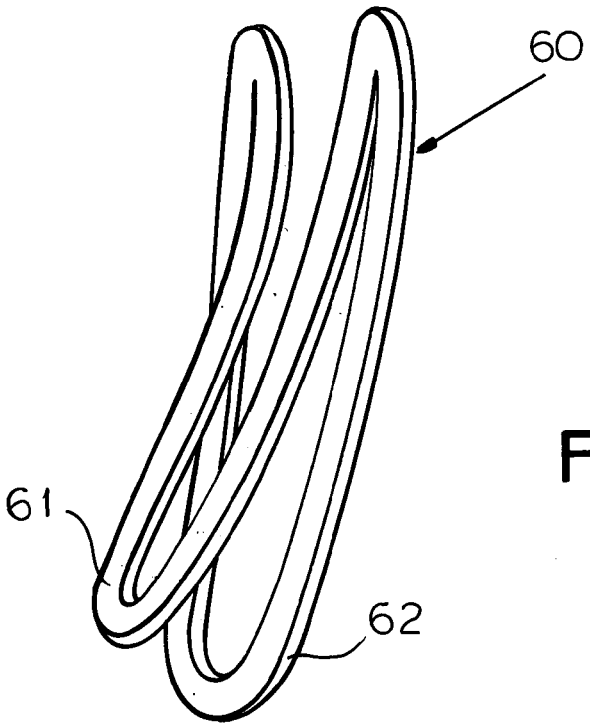
FIG. 9 is a diagram showing a possible relative shifting of the two limbs of the swing wire in diagrammatic form.

What is important in all embodiments, of course, is that the inner limb 61, as shown for the swing wire 60 in FIG. 9, can swing out of the plane of the outer limb 62. The swing has been exaggerated, of course, in both FIGS. 3 and 9 and will generally be substantially less.

Indeed, the swing wire 70 of FIG. 11 can be entirely encased in a foam synthetic resin 75 as shown in FIG. 11 and, in that case, the portion of the synthetic resin material 76 lining the inner limb 71 can be stiffer than the portion 77 of the synthetic resin material lining the outer limb 72.

Figure 10:
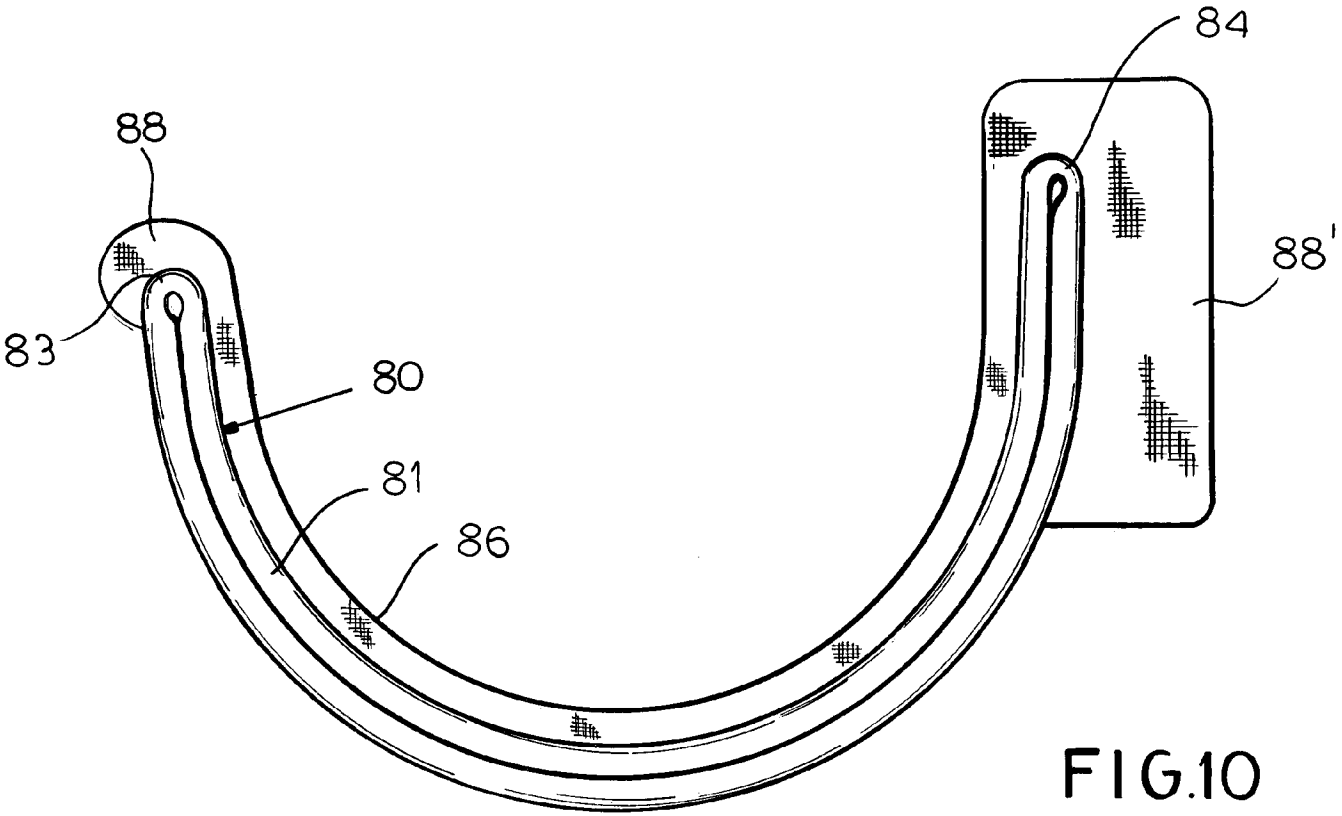
FIG. 10 is an elevational view of a swing wire according to another feature of the invention.

In FIG. 10, only the inner limb 81 of the swing wire 80 is lined with the foam synthetic resin material 86 which can have a portion 88 reaching over one end 83 of the swing wire while the other end 84, adapted to be located at the center of the front of the bra is formed with a tab 88' of the synthetic resin material. The tab 88' can serve to anchor the swing wire in place and can be stitched through in the assembly of the bra.

Frequently, the bra will have a molded cup 91 and, in that case, the swing underwire 90 can be incorporated onto that cup in the molding process. In that case, preferably, the swing wire 90 has a concave outward configuration as shown in FIG. 14. The wire 90 can be a dual wire as described with the inner limb being relatively softer and the outer rim relatively harder. The shape of the wire can be imparted in the mold in which the foam is injected around the wire.

The arcuate shape of the swing wire and the cup portion into which it is molded at 92 conforms generally to the shape of the sternum at the junction of the breast therewith and thus creates a more comfortable engagement of the bra against the sternum of the wearer.

We claim:

1. An underwire for a breast cup stay comprising a flat arcuate plastic body having ends provided with rounded tips and a continuous split subdividing the body between the ends into two adjacent arcuate segments extending substantially a full length of the plastic body between said ends, one of said segments being swingable transversely relative to the other segment and to a plane of said body, the arcuate segments having different degrees of stiffness.

2. The underwire defined in claim 1 wherein said body is of uniform width between said ends.

3. The underwire defined in claim 2 wherein said segments are of substantially equal width.

4. The underwire defined in claim 1 wherein the segments are a unitary single piece.

5. The underwire defined in claim 1 which is assembled from two wire segments fused together at said ends.

6. The underwire defined in claim 1 wherein an inner one of said segments is softer than an outer one of said segments.

7. The underwire defined in claim 1, further comprising a foam synthetic resin material bonded to at least one of said segments.

8. The underwire defined in claim 7 wherein said foam synthetic resin material encases said plastic body at least in part.

9. The underwire defined in claim 8 wherein said foam synthetic resin forms a bra cup directly.

10. The underwire defined in claim 9 wherein said arcuate plastic body has an outwardly concave curvature in a cross section through said body between said ends.

11. A brassiere comprising a pair of brassiere cups each provided with an underwire with each of said underwires comprising a flat arcuate plastic body having ends provided with rounded tips and a continuous split subdividing the body between the ends into two adjacent arcuate segments extending substantially a full length of the plastic body between said ends, one of said segments being swingable transversely relative to the other segment and to a plane of said body, an inner one of the segments having a smaller stiffness and hardness than an outer one of the segments.

12. The brassiere defined in claim 11 wherein each of said bodies is of uniform width between the respective ends.

13. The brassiere defined in claim 12 wherein said segments are of substantially equal width.

14. The brassiere defined in claim 11 wherein each of said underwires is injection-molded in a single piece.

15. The brassiere defined in claim 11 wherein each of said underwires is assembled from two wire segments fused together at said ends.

16. The bra defined in claim 11 wherein said body is embedded into a respective cup and has an arcuate cross section concave outwardly between the respective ends.

17. The bra defined in claim 11, further comprising a foam synthetic resin material bonded to at least one of said segments.

18. A molded bra cup of a foam synthetic resin material in which a swing underwire is embedded at least along an underside of said cup, the underwire comprising an arcuate plastic body having two ends and subdivided therebetween into two adjacent arcuate segments each having a different degree of stiffness.

* * * * *